US010405105B2

(12) United States Patent
Kursula et al.

(10) Patent No.: US 10,405,105 B2
(45) Date of Patent: Sep. 3, 2019

(54) MEMS MICROPHONE MAXIMUM SOUND PRESSURE LEVEL EXTENSION

(71) Applicant: INTEL CORPORATION, Santa Clara, CA (US)

(72) Inventors: Mikko Kursula, Lempaala (FI); Kalle I. Makinen, Nokia (FI); Roope S. Kiiski, Tampere (FI)

(73) Assignee: Intel Corporation, Santa Clara, CA (US)

( * ) Notice: Subject to any disclaimer, the term of this patent is extended or adjusted under 35 U.S.C. 154(b) by 80 days.

(21) Appl. No.: 15/410,298

(22) Filed: Jan. 19, 2017

(65) Prior Publication Data

US 2018/0206042 A1 Jul. 19, 2018

(51) Int. Cl.

| | |
|---|---|
| ***H04R 19/04*** | (2006.01) |
| ***H04R 1/32*** | (2006.01) |
| ***H04R 29/00*** | (2006.01) |

(52) U.S. Cl.

CPC ..... *H04R 19/04* (2013.01); *H04R 1/326* (2013.01); *H04R 29/004* (2013.01); *H04R 2201/003* (2013.01)

(58) Field of Classification Search

CPC ..... H04R 1/326; H04R 19/04; H04R 29/004; H04R 2201/003

See application file for complete search history.

(56) References Cited

U.S. PATENT DOCUMENTS

| | | | | |
|---|---|---|---|---|
| 8,447,054 | B2 * | 5/2013 | Bharatan | H04R 1/28 381/358 |
| 2014/0169585 | A1 * | 6/2014 | Howes | H04R 1/086 381/91 |
| 2015/0014796 | A1 * | 1/2015 | Dehe | B81B 7/0016 257/416 |

* cited by examiner

*Primary Examiner* — Brian Ensey

(74) *Attorney, Agent, or Firm* — International IP Law Group, P.L.L.C.

(57) ABSTRACT

A micro electro-Mechanical System (MEMS) microphone includes a first back plate positioned on top of a first moving plate, wherein the first moving plate flexes in response to changes in air pressure caused by audio signals. The MEMS microphone also includes a valve comprising a valve moving plate, wherein a first end of the valve moving plate is fixedly attached to a MEMS die and the valve moving plate flexes in response to high sound pressure levels such that a second end of the valve moving plate enables airflow to prevent audio signal distortion.

24 Claims, 12 Drawing Sheets

400A

200A

200B

200C

300A

300B

300C

400A

400B

500

600

MEMS MICROPHONE MAXIMUM SOUND PRESSURE LEVEL EXTENSION

BACKGROUND ART

A Micro Electro-Mechanical System (MEMS) microphone may be formed by etching a pressure-sensitive diaphragm or acoustic sensor directly onto a silicon wafer via MEMS processing techniques. Layers of various materials are deposited on top of a silicon wafer and then the unwanted material is then etched away creating a moveable membrane and a fixed back plate over a cavity in the base wafer. The fixed back plate is a stiff perforated structure which enables the passage of air, while the membrane is a thin solid structure that flexes in response to changes in air pressure caused by sound waves. Thus, MEMS microphones have one sound inlet and a sealed back cavity, and the MEMS sensor measures the air pressure difference between the sound inlet and the back cavity.

BRIEF DESCRIPTION OF THE DRAWINGS

The same numbers are used throughout the disclosure and the figures to reference like components and features. Numbers in the 100 series refer to features originally found in FIG. 1; numbers in the 200 series refer to features originally found in FIG. 2; and so on.

DESCRIPTION OF THE EMBODIMENTS

Figure 1:
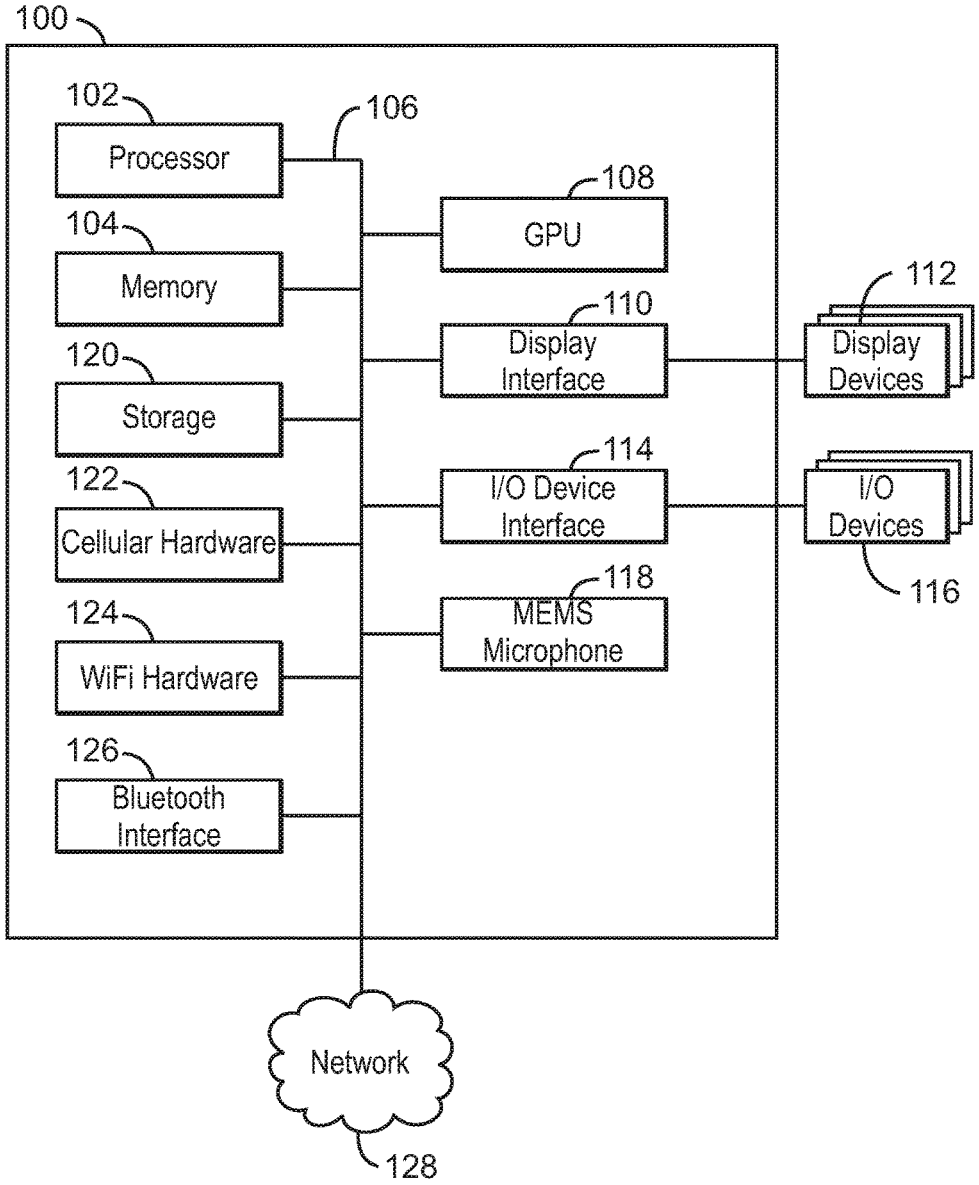
FIG. 1 is a block diagram of an electronic device that enables a MEMS microphone maximum sound pressure level extension.

MEMS microphone components are commonly used in electronic devices. These microphones have a limited sound pressure level (SPL) range within which they are able to capture sound without distortion or clipping. As used herein, distortion refers to any alteration in a sound wave/audio signal, while clipping is a specific distortion where peaks of the sound wave/audio signal are cut or flattened at the maximum capacity of the microphone. At high sound pressure levels, which are typically at 120 decibels (dB) and above, the moving membrane of the microphone hits the back plate or reaches the limits of a linear displacement range. The linear displacement range refers to the physical range of movement of the moving membrane.

High SPL levels are common in outdoor usage applications. For example, outdoor usage applications include windy conditions such as turbulence noise caused by wind, near transportation vehicles or construction machines, and in music concerts. Under these circumstances, the microphone signal quality may be distorted or clipped, which results in unusably bad voice quality in voice calls or poor video recording audio quality. Typically, the high SPL levels occur at low frequencies. In some cases, signal content can be removed via acoustic filter structures.

Embodiments described herein enable a MEMS microphone maximum sound pressure level extension. In embodiments, a MEMS valve is placed between a back cavity and a sound inlet. The valve is designed so that opening the valve will cause an acoustic high-pass filter effect that reduces a pressure difference in the back cavity at low frequencies, thus removing the risk of MEMS microphone clipping or distortion. In embodiments, the valve is electrically controlled by algorithms that can identify the signal clipping.

Some embodiments may be implemented in one or a combination of hardware, firmware, and software. Some embodiments may also be implemented as instructions stored on the tangible, non-transitory, machine-readable medium, which may be read and executed by a computing platform to perform the operations described. In addition, a machine-readable medium may include any mechanism for storing or transmitting information in a form readable by a machine, e.g., a computer. For example, a machine-readable medium may include read only memory (ROM); random access memory (RAM); magnetic disk storage media; optical storage media; flash memory devices; or electrical, optical, acoustical or other form of propagated signals, e.g., carrier waves, infrared signals, digital signals, or the interfaces that transmit and/or receive signals, among others.

An embodiment is an implementation or example. Reference in the specification to "an embodiment," "one embodiment," "some embodiments," "various embodiments," or "other embodiments" means that a particular feature, structure, or characteristic described in connection with the embodiments is included in at least some embodiments, but not necessarily all embodiments, of the present techniques. The various appearances of "an embodiment," "one embodiment," or "some embodiments" are not necessarily all referring to the same embodiments.

Not all components, features, structures, characteristics, etc. described and illustrated herein need be included in a particular embodiment or embodiments. If the specification states a component, feature, structure, or characteristic "may", "might", "can" or "could" be included, for example, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

FIG. 1 is a block diagram of an electronic device 100 that enables a MEMS microphone maximum sound pressure level extension. The electronic device 100 may be, for example, a laptop computer, tablet computer, mobile phone, smart phone, or a wearable device, among others. The electronic device 100 may include a central processing unit (CPU) 102 that is configured to execute stored instructions, as well as a memory device 104 that stores instructions that are executable by the CPU 102. The CPU may be coupled to the memory device 104 by a bus 106. Additionally, the CPU 102 can be a single core processor, a multi-core processor, a computing cluster, or any number of other configurations. Furthermore, the electronic device 100 may include more than one CPU 102. The memory device 104 can include random access memory (RAM), read only memory (ROM), flash memory, or any other suitable memory systems. For example, the memory device 104 may include dynamic random access memory (DRAM).

The electronic device 100 also includes a graphics processing unit (GPU) 108. As shown, the CPU 102 can be coupled through the bus 106 to the GPU 108. The GPU 108 can be configured to perform any number of graphics operations within the electronic device 100. For example, the GPU 108 can be configured to render or manipulate graphics images, graphics frames, videos, or the like, to be displayed to a user of the electronic device 100. In some embodiments, the GPU 108 includes a number of graphics engines, wherein each graphics engine is configured to perform specific graphics tasks, or to execute specific types of workloads. For example, the GPU 108 may include an engine that processes video data.

The CPU 102 can be linked through the bus 106 to a display interface 110 configured to connect the electronic device 100 to a display device 112. The display device 112 can include a display screen that is a built-in component of the electronic device 100. The display device 112 can also include a computer monitor, television, or projector, among others, that is externally connected to the electronic device 100.

The CPU 102 can also be connected through the bus 106 to an input/output (I/O) device interface 114 configured to connect the electronic device 100 to one or more I/O devices 116. The I/O devices 116 can include, for example, a keyboard and a pointing device, wherein the pointing device can include a touchpad or a touchscreen, among others. The I/O devices 116 can be built-in components of the electronic device 100, or can be devices that are externally connected to the electronic device 100.

A MEMS microphone 118 may be used to capture sound waves. For example, the electronic device 100 may be a smart phone and the MEMS microphone may be used to capture sound waves during phone calls or video recordings. The MEMS microphone may be dynamically adjusted to match sound capture conditions present in the current environment. Sound capture conditions include, but are not limited to, external factors that can degrade sound waves to be captured by the MEMS microphone 118. A MEMS valve within the MEMS microphone can be used to create a high-pass filter effect in order to enable sound waves with a frequency higher than a particular cut-off frequency to pass, while attenuating frequencies lower than the cut-off frequency.

The electronic device may also include a storage device 120. The storage device 120 is a physical memory such as a hard drive, an optical drive, a flash drive, an array of drives, or any combinations thereof. The storage device 120 can store user data, such as audio files, video files, audio/video files, and picture files, among others. The storage device 120 can also store programming code such as device drivers, software applications, operating systems, and the like. The programming code stored to the storage device 120 may be executed by the CPU 102, GPU 108, or any other processors that may be included in the electronic device 100.

The CPU 102 may be linked through the bus 106 to cellular hardware 122. The cellular hardware 122 may be any cellular technology, for example, the 4G standard (International Mobile Telecommunications-Advanced (IMT-Advanced) Standard promulgated by the International Telecommunications Union-Radio communication Sector (ITU-R)). In this manner, the electronic device 100 may access any network 128 without being tethered or paired to another device, where the network 128 is a cellular network.

The CPU 102 may also be linked through the bus 106 to WiFi hardware 124. The WiFi hardware is hardware according to WiFi standards (standards promulgated as Institute of Electrical and Electronics Engineers' (IEEE) 802.11 standards). The WiFi hardware 124 enables the electronic device 100 to connect to the Internet using the Transmission Control Protocol and the Internet Protocol (TCP/IP), where the network 128 is the Internet. Accordingly, the electronic device 100 can enable end-to-end connectivity with the Internet by addressing, routing, transmitting, and receiving data according to the TCP/IP protocol without the use of another device. Additionally, a Bluetooth Interface 126 may be coupled to the CPU 102 through the bus 106. The Bluetooth Interface 126 is an interface according to Bluetooth networks (based on the Bluetooth standard promulgated by the Bluetooth Special Interest Group). The Bluetooth Interface 126 enables the electronic device 100 to be paired with other Bluetooth enabled devices through a personal area network (PAN). Accordingly, the network 128 may be a PAN. Examples of Bluetooth enabled devices include a laptop computer, desktop computer, ultrabook, tablet computer, mobile device, or server, among others.

The block diagram of FIG. 1 is not intended to indicate that the electronic device 100 is to include all of the components shown in FIG. 1. Rather, the computing system 100 can include fewer or additional components not illustrated in FIG. 1 (e.g., sensors, power management integrated circuits, additional network interfaces, etc.). The electronic device 100 may include any number of additional components not shown in FIG. 1, depending on the details of the specific implementation. Furthermore, any of the functionalities of the CPU 102 may be partially, or entirely, implemented in hardware and/or in a processor. For example, the functionality may be implemented with an application specific integrated circuit, in logic implemented in a processor, in logic implemented in a specialized graphics processing unit, or in any other device.

In embodiments, the MEMS microphone dynamically controls a low frequency sensitivity of the microphone so that the sensitivity is matched to the sound capturing conditions where the microphone is operated. In embodiments, an effective cutoff frequency can be dynamically adjusted via a MEMS valve of the MEMS microphone. The present techniques prevent microphone signal clipping due to wind noise, high-level sound in a rock concert, a door slam, or tapping at or near a microphone opening of the device with a finger. In these use cases, the highest SPL signal content occurs typically in a low frequency region, which gets attenuated via the effective cutoff frequency created by the MEMS value. At the same time, the mid- and high-frequency range sound is unaffected. Put another way, at the mid- and high-frequencies, the microphone delivers a normal, expected performance while attenuating low-frequencies which cause signal distortion. In traditional microphones those low frequency noise sources (wind turbulence etc.) will cause a MEMS sensor saturation that completely ruins the signal content of the full audio band. MEMS sensor saturation cannot be addressed via post-processing. As used herein, the MEMS sensor refers to an acoustic sensor of the MEMS microphone that may be used to capture sound waves.

In embodiments, the MEMS microphone with an SPL extension delivers the benefits of a high-SPL microphone at a much lower cost, since the present techniques use a single MEMS microphone sensor and a single MEMS valve/vent, which are much cheaper to implement than a second MEMS microphone sensor. Typically, high-SPL MEMS microphones employ dual MEMS sensors, one for the normal SPL range and the second one for the high-SPL range. The high-SPL mode is typically 140 dB SPL and up, and the normal SPL range is typically around 120 dB SPL. In embodiments, the present techniques do not require additional pins or signals for the MEMS microphone component. Additionally, in embodiments the MEMS microphone utilizes a Mobile Industry Processor Interface (MIPI) SoundWire protocol, in which all the control signaling can be embedded to the same communication that is used to deliver microphone signal data. The MIPI SoundWire protocol is promulgated by the MIPI Alliance, including SLIMbus (initially released in 2007) and Soundwire (released in 2014).

Figure 2A:
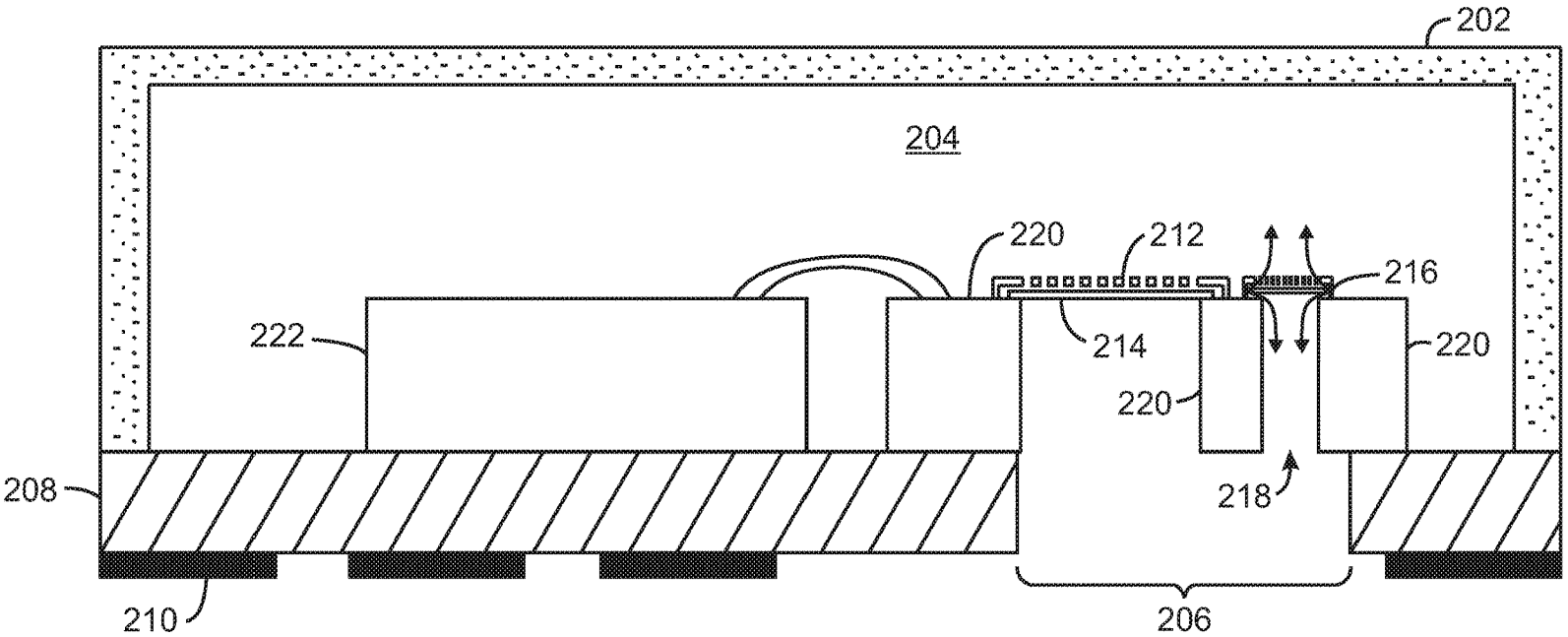
FIG. 2A is a cross section of a MEMS microphone with a maximum sound pressure level (SPL) extension.

FIG. 2A is a cross section of a MEMS microphone 200A with a maximum sound pressure level (SPL) extension. The MEMS microphone 200A includes a shield enclosure 202. The shield enclosure 202 enables a sealed back cavity 204 for the sound capturing components of the MEMS microphone die 220. The MEMS microphone die 220 is electrically coupled with an amplifier die 222. The back cavity 204 of the microphone is sealed such that there is no free air exchange between a sound inlet 206 and the back cavity 204, which creates a flat frequency response at low frequencies. A flat frequency response is one that is equally sensitive to all frequencies. A flat frequency response is desired to accurately capture pure audio signals/sound waves. Sound waves are captured by various components as they enter the sound inlet 206. A substrate 208 and a plurality of contact pads 210 provide electrical connections to and from the MEMS microphone 200A.

The back plate 212 may be fixed over a moving plate 214 and the sound inlet 206. The microphone back plate 212 includes perforations that enable the passage of air. The moving plate 214 is a thin structure that flexes or vibrates in response to changes in air pressure caused by sound waves. A MEMS valve 216 is positioned over the sound inlet 206, and enables a valve air path 218. The valve 218 enables a controlled air flow path between the sound inlet 206 and the back cavity 204.

Figure 2B:
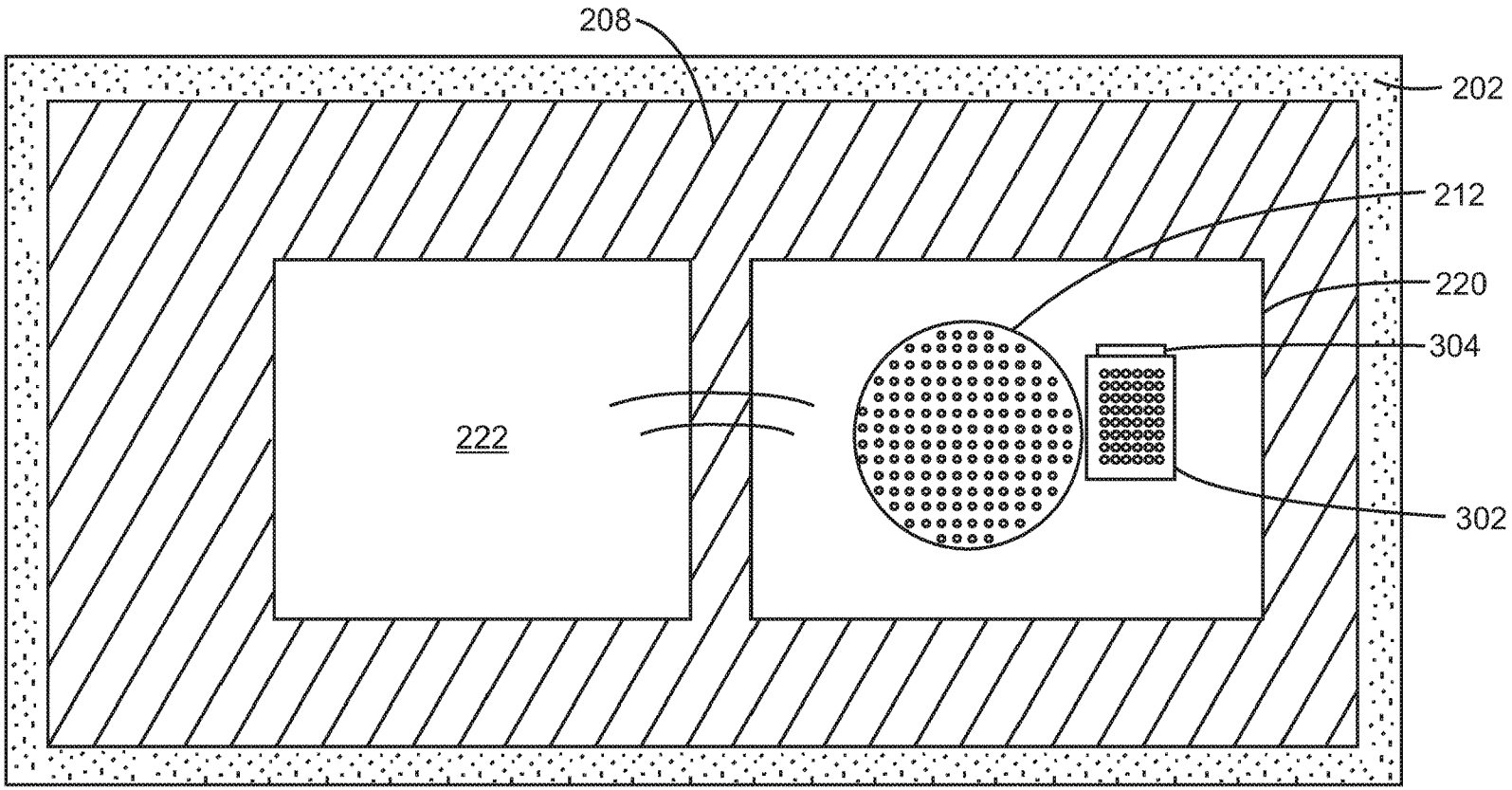
FIG. 2B is a top view of a MEMS microphone with a maximum sound pressure level (SPL) extension.
Figure 2C:
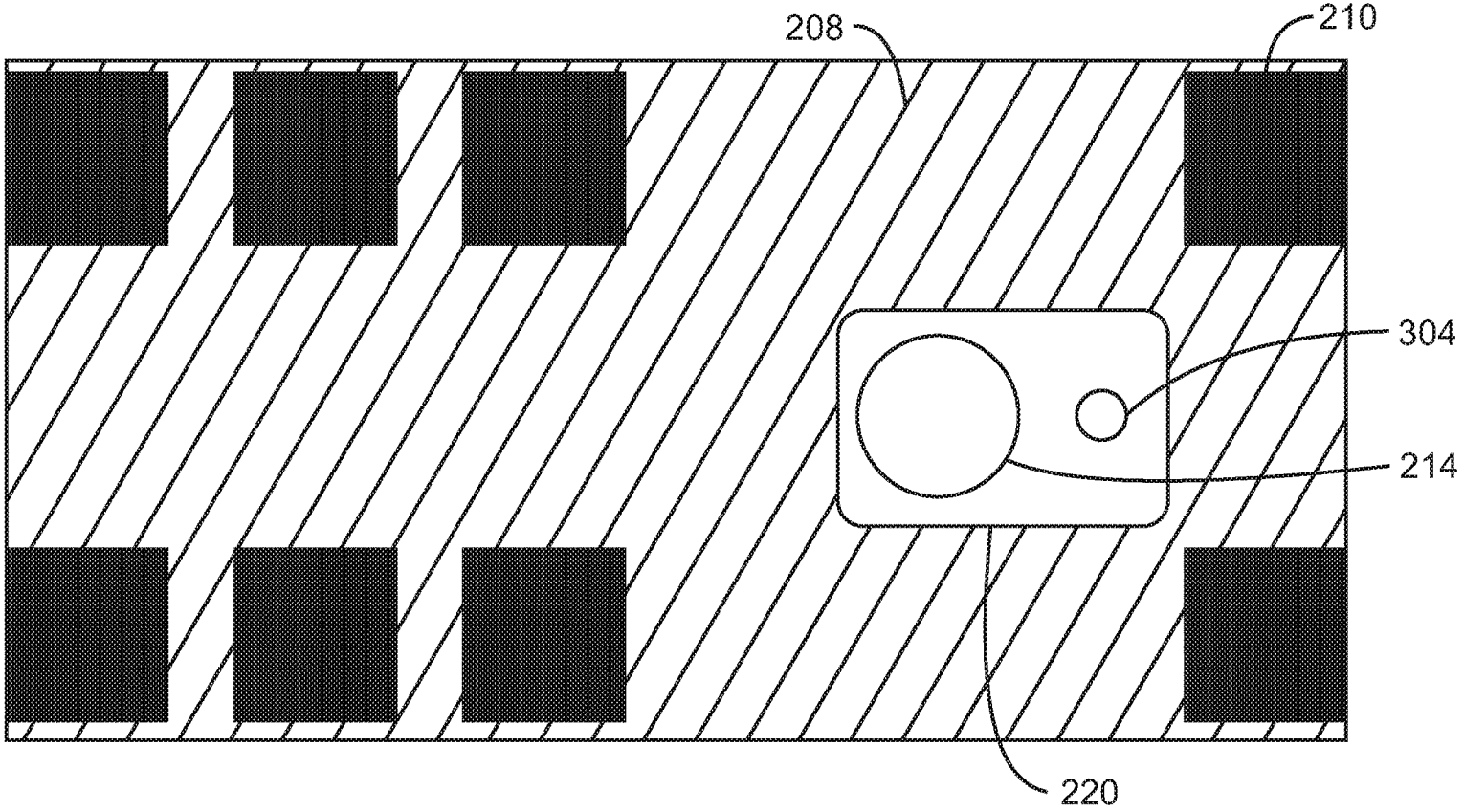
FIG. 2C is a bottom view of a MEMS microphone with a maximum sound pressure level (SPL) extension.

FIG. 2B is a top view of a MEMS microphone 200B with a maximum sound pressure level (SPL) extension. In FIG. 2B, a portion of the shield enclosure 202 is removed. As illustrated, the MEMS microphone 220 is a die with various microphone components affixed to the die. In particular, the MEM valve 216 is illustrated with a back plate 302 and a moving plate 304. The back plate 302 and the moving plate 304 will be described further with respect to FIG. 3. FIG. 2C is a bottom view of a MEMS microphone 200C with a maximum sound pressure level (SPL) extension. In FIG. 2C, contact pads 210 are positioned along the substrate 208. The moving plate 214 and the valve moving plate 304 are illustrated on the MEMS die 220. While not illustrated, the sound inlet 206 enables sound waves to cause vibrations at the moving plate 214 and the moving plate 304.

Figure 3A:
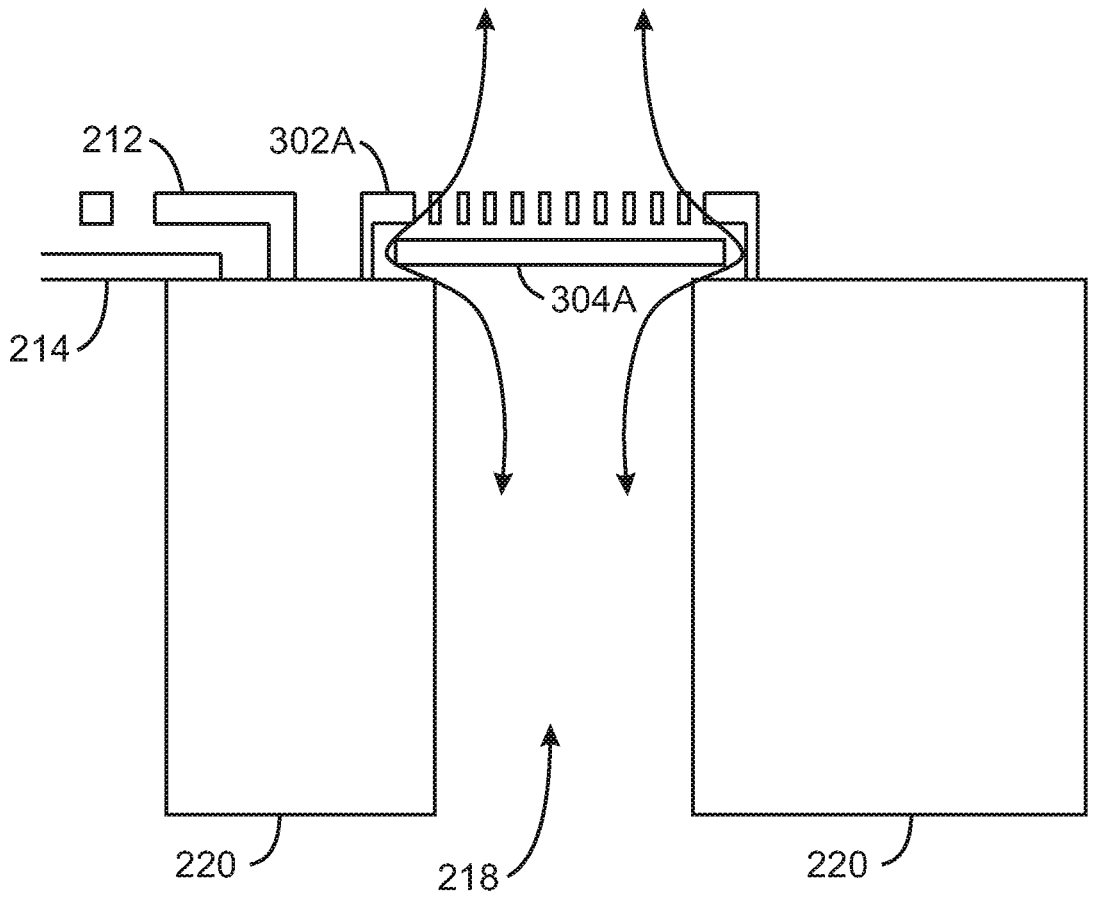
FIG. 3A is a cross section of a MEMS valve.

FIG. 3A is a cross section of a MEMS valve 300A. The MEMS valve 300 may be the MEMS valve 216 in an open position. In an open position, air is allowed to flow between the back cavity and the sound inlet of the MEMS microphone. The MEMS valve includes a back plate 302A and a moving valve/plate 304A. The valve cross section is designed to be small so that the acoustic path resistance together with the back cavity volume creates a low pass response when filtering the audio signals, i.e., the air can move below a certain cutoff frequency. In embodiments, the valve is electrically controlled to open or closed state. In embodiments, actuator can move the valve to cause varying amounts of air to flow around the moving valve/plate 304A and through the back plate 302A. In embodiments, the back plate 302A includes an electrode or actuator.

For example, assume that the cutoff frequency is, e.g., 100 Hz. At below 100 Hz the air flow will reduce a pressure difference between the moving front plate and the back plate, thus the microphone frequency response is acoustically high-pass filtered below 100 Hz and the "flat" frequency response will be from 100 Hz to the top of the audio frequency range. In embodiments, the valve air path 218 and the back cavity will create a high-pass filter response, with a predictable amplitude and phase response. Thus, a high-pass frequency filter response is created at the microphone, and a low-pass response results from the MEMS valve.

Figure 3B:
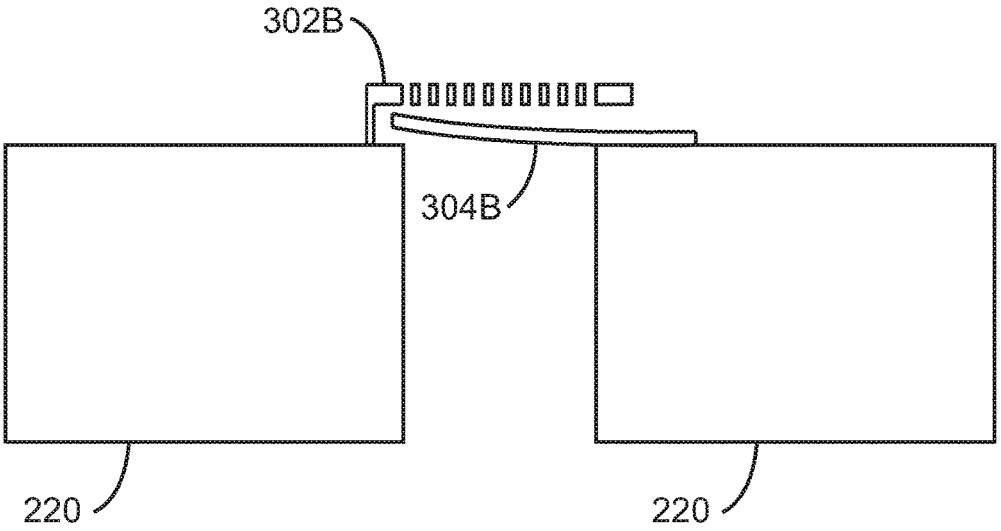
FIG. 3B is a cross section of a MEMS valve.
Figure 3C:
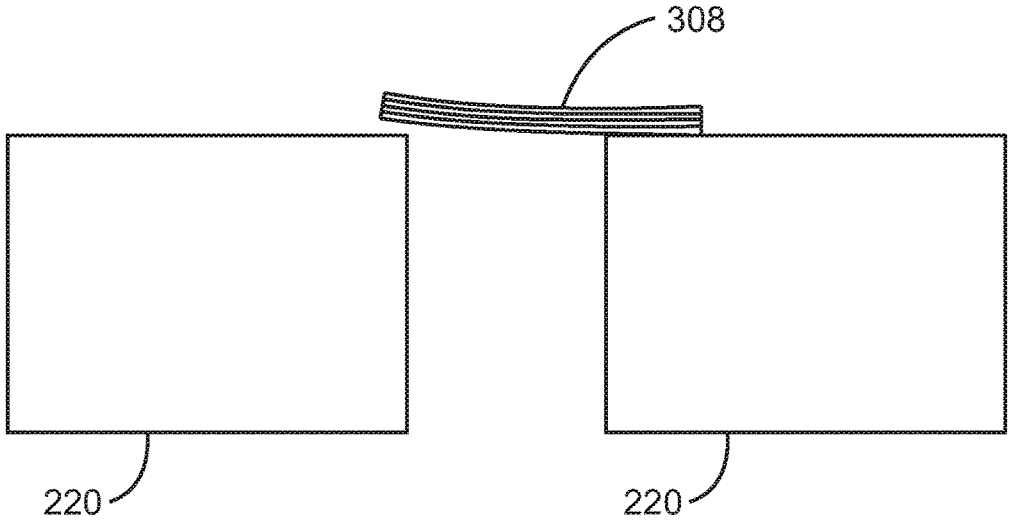
FIG. 3C is a cross section of a MEMS valve.

FIG. 3B is a cross section of a MEMS valve 300B. Voltage between the valve moving plate 304B and the fixed plate 302B causes the moving plate 304B to bend and open causing air to flow past the valve moving plate 304B. One end of the valve moving plate 304B may be fixed to the die 220. In embodiments, an electrostatic force may be used to operate the valve. FIG. 3C is a cross section of a MEMS valve 300C. In the MEMS valve 300C, the valve operates via a piezoelectric actuator that is integrated into the moving plate 308. The moving plate 308 may include two additional layers for the piezoelectric actuator. In embodiments, the piezoelectric actuator does not include a fixed plate. Rather, the opening and closing of the valve 300C is dependent on the piezoelectric actuator integrated into the moving plate 308.

In embodiments, the valve is implemented using MEMS technologies and uses piezoelectric or electrostatic actuators for the valve movement. Electrical energy may be used to cause a small motion or force that is to move the actuator according to the environmental conditions. A set of algorithms may be used to translate the environmental conditions into a MEMS valve setting. In embodiments, the MEMS valve settings are dynamic in response to changing environmental conditions.

The MEMS valve on/off control can also be implemented using hardware or software controls. For example, a hardware control may be used that monitors the microphone signal and opens the valve when clipping occurs or too high signal amplitudes occur in the microphone signal. Clipping may be detected by analyzing a waveform of the sound signal to observe clipping. Amplitudes that are too high may be detected by comparing the amplitude to an amplitude of a pre-determined frequency response for the MEMS microphone. The pre-determined amplitude may be based on frequencies that the microphone is expected to accurately capture.

In embodiments, a software control may be used that monitors the microphone signal and controls the valve based on the signal analysis results. The algorithms could monitor environmental noise factors in the microphone signal and open the valve when the noise factors exceed a threshold. The threshold may be a decibel level or frequency level that creates a high sound pressure level at the MEMS microphone. A high SPL may be, for example, approximately 140 dB SPL. The noise factors may be wind noise or other undesirable noise in the audio signal. Moreover, the algorithm can monitor the attenuated low frequency signals to estimate when it is feasible to close the valve and resume normal (flat frequency response) operation.

Noise factors such as wind noise are typically concentrated in the very low frequency end of the acoustic signal spectrum, so it is easy to detect and to remove via the present techniques. If the noise factors are not acoustically removed, they can cause microphone signal clipping and irreversibly ruin the entire audio band signal quality. The present techniques can be used to mitigate noise factors such as excessive audio at rock concert SPLs, door slam noises, device handling noises (finger tapping the sound hole) and other conditions in wearable, mobile, or internet-of-things (IoT) device usage that may cause microphone signal clipping. Such filtering is especially important for systems that perform speech analysis (e.g. voice controlled assistant devices), since those devices rely on continuous microphone signal recording and require good signal quality.

In embodiments, the MEMS valve system may also contain multiple individually controllable valves in parallel so that the high-pass cut-off frequency can be adjusted by switching part of the valves on or off. In one scenario, the full audio band may be attenuated to ensure that the acoustic signal can be recorded without clipping or excessive distortion. Moreover, in embodiments, such a microphone system can be accompanied by barometer sensor system. The barometer sensor system enables pressures to be measured. At least one MEMS value can be adjusted based on the measured atmospheric pressure. Barometers typically have a frequency response that enables the sensor to be used to record low frequency audio at very high sound pressure levels. The signal from barometer and from the MEMS microphone with SPL extension can be combined so that the combined signal has very high dynamic range at low frequencies.

The device software may need information about the valve open/closed status so that the dynamic changes in microphone frequency response do not cause adverse effects in audio processing algorithms. For example, if multiple microphones are in an array configuration and beamforming algorithms are used, the algorithms may need to take into account the microphone amplitude and phase response changes when the valve is opened in some of the microphones. The present techniques are able to provide a valve status to audio processing algorithms.

Figure 4A:
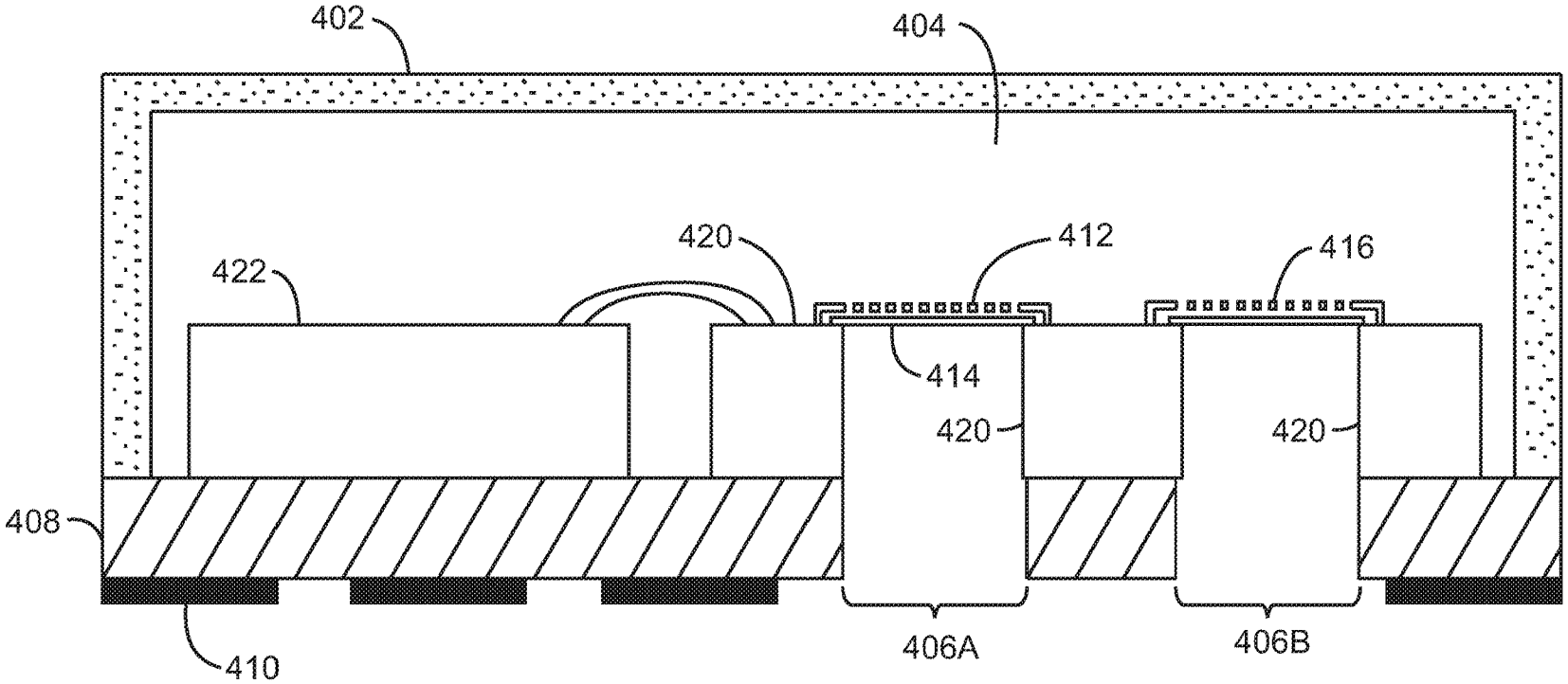
FIG. 4A is a cross section of a MEMS microphone with a maximum sound pressure level (SPL) extension.

FIG. 4A is a cross section of a MEMS microphone 400A with a maximum sound pressure level (SPL) extension. The MEMS microphone 400A is similar to the MEMS microphone 200A, and includes a shield enclosure 402, a sealed back cavity 404, a MEMS microphone die 420, and an amplifier die 422. In the alternative implementation of the MEMS microphone 400A, the valve structure 416 can be used to modify the microphone directional response. If the design is modified so that the valve has larger cross sectional area that creates a cutoff frequency above the audio band and two acoustic inlets are used instead of one, it enables the microphone directional response to be switched between omnidirectional and a more directional response depending on the sound inlet locations in the device mechanics. The directional response is usable in extremely noisy conditions for capturing voice at close distance from mouth while background noise is cancelled (e.g., motorcycle helmet microphone).

Figure 4B:
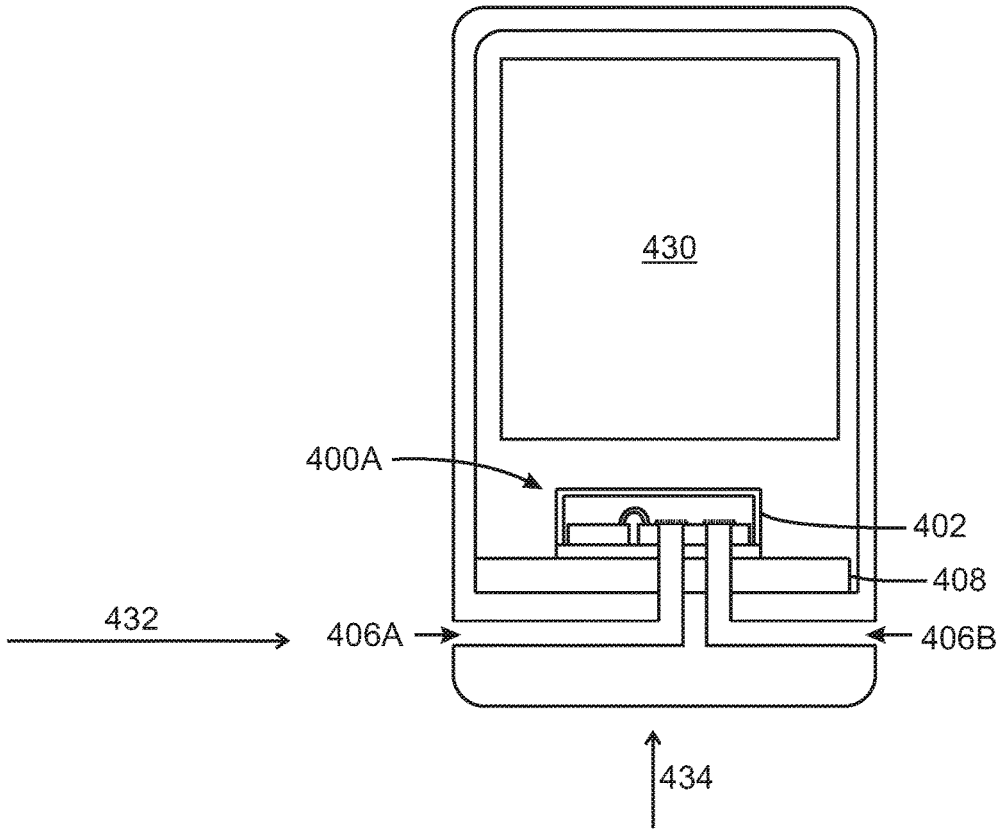
FIG. 4B is an illustration of a MEMS microphone within a device with a directional response.

FIG. 4B is an illustration of a MEMS microphone 400A within a device 400B with a directional response. The device 400B includes other electronics 430. In embodiments, sound captured via the sound inlet 406A will not be attenuated since there is a sound pressure difference between the inlets and thus the microphone generates signal output. In embodiments, the sound inlet 406A may be often directed toward the sound source as indicated by arrow 432, such as the mouth of a user of the phone in telephone applications. Sound from a direction as indicated by arrow 434 will be attenuated, as both sound inlets 406A and 406B receive the same signal. Put another way, the differential sound pressure is zero between the sound inlets 406A and 406B, thus the microphone will not capture sound waves resulting from these other directions. In embodiments, this omnidirectional configuration can be used in noise cancelling applications, where the direction 434 is toward the source of noise.

Figure 5:
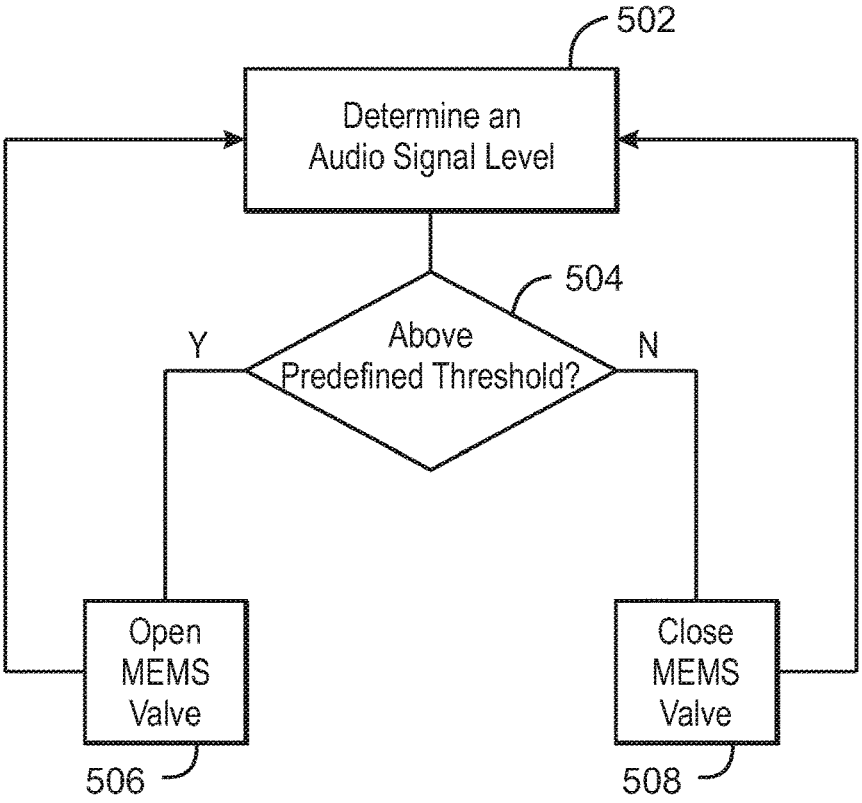
FIG. 5 is a process flow diagram of an algorithm for a MEMS microphone sound pressure level extension.

FIG. 5 is a process flow diagram of an algorithm for a MEMS microphone sound pressure level extension. In embodiments, the method is a signal level detector. At block 502, a sound wave signal level is determined. At block 504 it is determined if the signal level is above a predefined threshold. If the signal level is above the threshold process flow continues to block 506, where the MEMS valve is opened. If the signal level is below the threshold, process flow continues to block 508, where the MEMS valve is closed.

For ease of description, the MEMS valves have been described as having an open state where air is allowed to pass, and a closed state where no air is allowed to pass. However, the valves can also control the amount of air that is allowed to pass during an open state. The amount of air allowed to pass may be controlled by a single MEMS valve or a plurality of MEMS valves. The valves may be opened or closed at varying degrees in order to change the amount of air that can flow through the valve. In embodiments, the plurality of valves can provide a finer control of the air flow used to achieve a high SPL.

Figure 6:
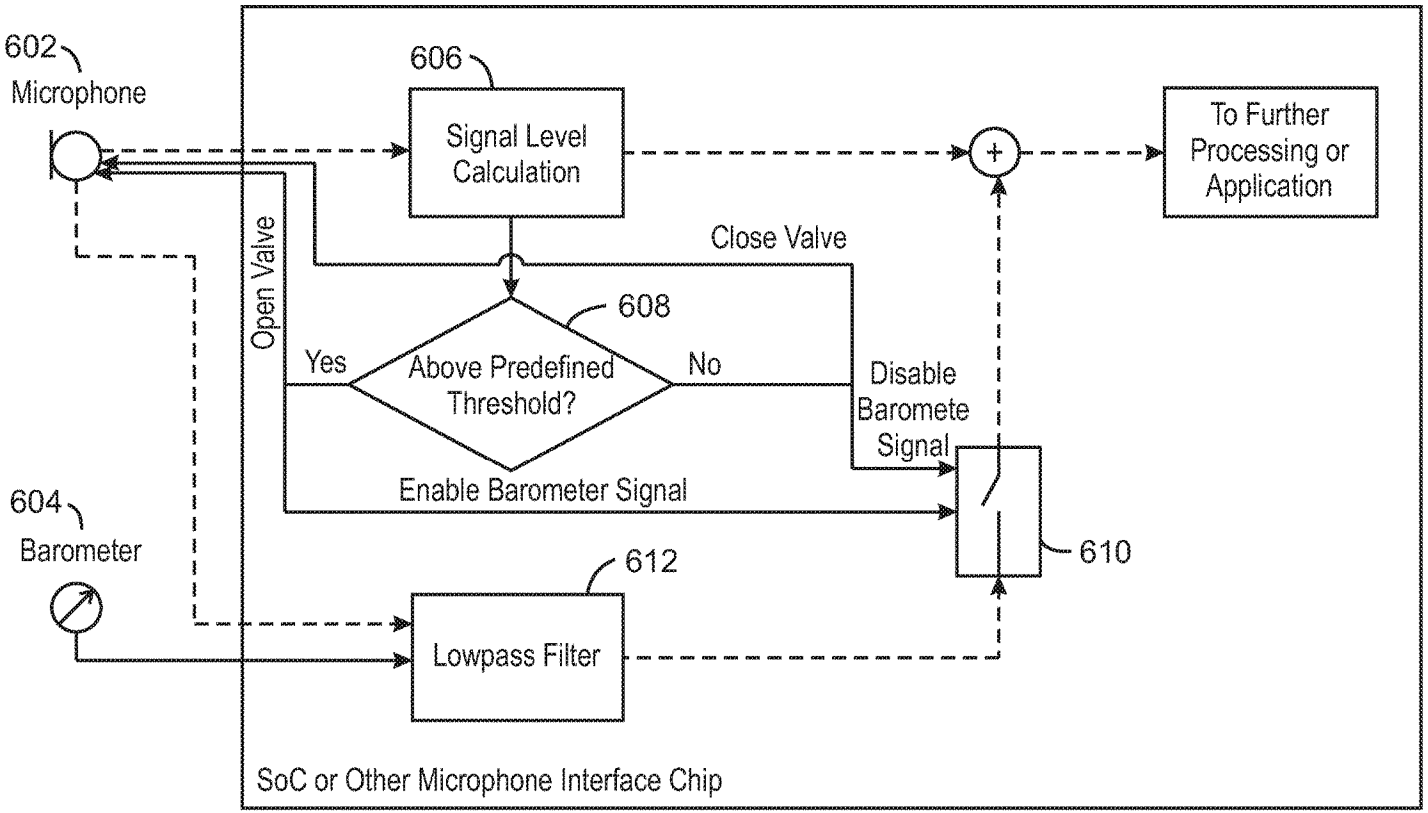
FIG. 6 is a process flow diagram of an algorithm for a MEMS microphone sound pressure level extension with a barometric signal.

FIG. 6 is a process flow diagram of method 600 for a MEMS microphone sound pressure level extension with a barometric signal. A microphone 602 may be used to capture audio signals above a cutoff frequency of the microphone (valve opened), while a barometer 604 may be used to capture audio signals below the cutoff frequency. At block 606, a signal level calculation is performed. At block 608, it is determined if the signal level is above a predefined threshold. If the signal level is above the threshold an open valve control signal is sent to the microphone. If the signal level is below the threshold a close valve control signal is sent to the microphone.

When the open valve signal is sent to the microphone, an enable barometric signal may be sent to a switch 610. The switch 610 may be closed to enable an audio signal from the low pass filter 612 to be combined with the original captured audio signal. The frequency response of the barometer 604 may enable the recoding system to be used to record low frequency audio at very high sound pressure levels. When the switch 610 is closed, the audio signals from each of the microphone and barometer may be summed and sent for further processing and/or to an application.

Figure 7:
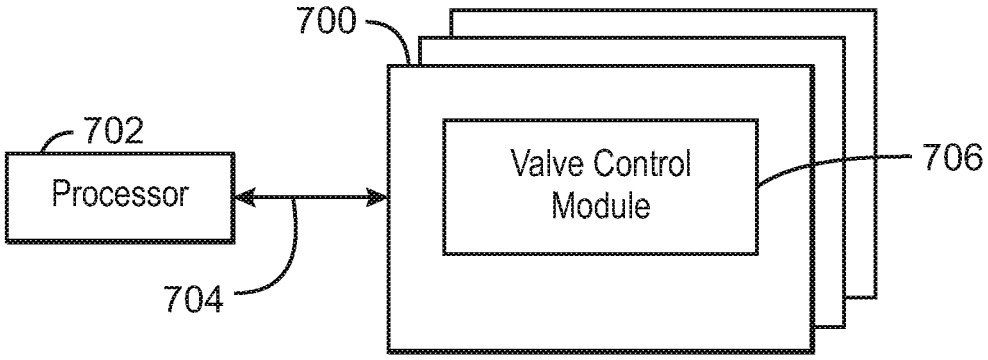
FIG. 7 is a block diagram showing a medium that contains logic for an algorithm for a MEMS microphone sound pressure level extension.

FIG. 7 is a block diagram showing a medium 700 that contains logic for an algorithm for a MEMS microphone sound pressure level extension. The medium 700 may be a computer-readable medium, including a non-transitory medium that stores code that can be accessed by a processor 702 over a computer bus 704. For example, the computer-readable medium 700 can be volatile or non-volatile data storage device. The medium 700 can also be a logic unit, such as an Application Specific Integrated Circuit (ASIC), a Field Programmable Gate Array (FPGA), or an arrangement of logic gates implemented in one or more integrated circuits, for example.

The medium 700 may include module 706 configured to perform the techniques described herein. For example, a valve control module 706 may be configured to determine an amount of air to be passed by the MEMS valve. A signal from the valve control module may be used to control the open/closed status of a plurality of MEMS valves. In some embodiments, the module 706 may be modules of computer code configured to direct the operations of the processor 702.

The block diagram of FIG. 7 is not intended to indicate that the medium 700 is to include all of the components shown in FIG. 7. Further, the medium 700 may include any number of additional components not shown in FIG. 7, depending on the details of the specific implementation.

Example 1 is a micro electro-Mechanical System (MEMS) microphone. The micro electro-Mechanical System (MEMS) microphone includes a first back plate positioned on top of a first moving plate, wherein the first moving plate flexes in response to changes in air pressure caused by audio signals; and a valve comprising a valve moving plate, wherein a first end of the valve moving plate is fixedly attached to a MEMS die and the valve moving plate flexes in response to high sound pressure levels such that a second end of the valve moving plate enables airflow to prevent audio signal distortion.

Example 2 includes the micro electro-Mechanical System (MEMS) microphone of example 1, including or excluding optional features. In this example, the valve comprises a second backplate.

Example 3 includes the micro electro-Mechanical System (MEMS) microphone of any one of examples 1 to 2, including or excluding optional features. In this example, an electrostatic force applied to the valve moving causes the valve moving plate to flex.

Example 4 includes the micro electro-Mechanical System (MEMS) microphone of any one of examples 1 to 3, including or excluding optional features. In this example, the valve comprises a piezoelectric actuator integrated into the valve moving plate.

Example 5 includes the micro electro-Mechanical System (MEMS) microphone of any one of examples 1 to 4, including or excluding optional features. In this example, the micro electro-Mechanical System (MEMS) microphone includes a hardware control to monitor the audio signal and open the valve in response to signal clipping or signal amplitudes above a threshold.

Example 6 includes the micro electro-Mechanical System (MEMS) microphone of any one of examples 1 to 5, including or excluding optional features. In this example, a cross sectional area of the valve is adjusted to enable a microphone directional response. Optionally, the valve creates a secondary acoustic inlet to enable the directional response.

Example 7 includes the micro electro-Mechanical System (MEMS) microphone of any one of examples 1 to 6, including or excluding optional features. In this example, airflow through the valve effectively applies a high pass filter to the audio signal captured by the first back plate and the first moving plate.

Example 8 includes the micro electro-Mechanical System (MEMS) microphone of any one of examples 1 to 7, including or excluding optional features. In this example, air passes though the valve below a cutoff frequency.

Example 9 includes the micro electro-Mechanical System (MEMS) microphone of any one of examples 1 to 8, including or excluding optional features. In this example, the micro electro-Mechanical System (MEMS) microphone includes a plurality of valves.

Example 10 is a system for a micro electro-Mechanical System (MEMS) microphone. The system includes a MEMS microphone comprising a valve with a valve back plate and a valve moving plate, wherein a first end of the valve moving plate is fixedly attached to a MEMS die and the valve moving plate flexes in response to high sound pressure levels such that a second end of the valve moving plate enables airflow to prevent audio signal distortion; a memory that is to store instructions and that is communicatively coupled to the microphone; and a processor communicatively coupled to the microphone and the memory, wherein when the processor is to execute the instructions, the processor is to: determine an audio signal level; in response to an audio signal level above a threshold, open the valve; and in response to an audio signal level below a threshold, close the valve.

Example 11 includes the system of example 10, including or excluding optional features. In this example, the threshold is a decibel level that causes a high sound pressure level at the MEMS microphone.

Example 12 includes the system of any one of examples 10 to 11, including or excluding optional features. In this example, the threshold is a frequency level that causes a high sound pressure level at the MEMS microphone.

Example 13 includes the system of any one of examples 10 to 12, including or excluding optional features. In this example, the valve is opened via an electrostatic force applied to the valve back plate causing the valve moving plate to flex.

Example 14 includes the system of any one of examples 10 to 13, including or excluding optional features. In this example, the valve is opened via a piezoelectric actuator integrated into the valve moving plate.

Example 15 includes the system of any one of examples 10 to 14, including or excluding optional features. In this example, the system includes a software control to monitor the audio signal and open the valve in response to signal clipping or signal amplitudes above a particular threshold.

Example 16 includes the system of any one of examples 10 to 15, including or excluding optional features. In this example, a cross sectional area of the valve is adjusted to enable a microphone directional response.

Example 17 includes the system of any one of examples 10 to 16, including or excluding optional features. In this example, the valve creates a secondary acoustic inlet to enable the directional response.

Example 18 includes the system of any one of examples 10 to 17, including or excluding optional features. In this example, airflow through the valve effectively applies a high pass filter to the audio signal captured by the first back plate and the first moving plate.

Example 19 includes the system of any one of examples 10 to 18, including or excluding optional features. In this example, air passes though the valve below a cutoff frequency.

Example 20 is an apparatus to mitigate MEMS microphone signal distortion. The apparatus includes a MEMS microphone comprising a first back plate positioned on top of a first moving plate to create a back cavity, wherein the first moving plate flexes in response to changes in air pressure caused by audio signals; and a pressure equalization unit to enable a second airflow to prevent audio signal distortion by reducing a pressure difference in the back cavity at low frequencies.

Example 21 includes the apparatus of example 20, including or excluding optional features. In this example, the pressure equalization unit is a valve comprising a valve moving plate, wherein a first end of the valve moving plate is fixedly attached to a MEMS die and the valve moving plate flexes in response to high sound pressure levels such that a second end of the valve moving plate enables airflow to prevent audio signal distortion.

Example 22 includes the apparatus of any one of examples 20 to 21, including or excluding optional features. In this example, an electrostatic force applied to the pressure equalization unit causes a valve moving plate to flex.

Example 23 includes the apparatus of any one of examples 20 to 22, including or excluding optional features. In this example, the pressure equalization unit comprises a piezoelectric actuator integrated into a valve moving plate.

Example 24 includes the apparatus of any one of examples 20 to 23, including or excluding optional features. In this example, the pressure equalization unit comprises a hardware control to monitor the audio signals and open a valve in response to signal clipping or signal amplitudes above a threshold.

Example 25 includes the apparatus of any one of examples 20 to 24, including or excluding optional features. In this example, a cross sectional area of at least one valve of the pressure equalization unit is adjusted to enable a microphone directional response.

Example 26 includes the apparatus of any one of examples 20 to 25, including or excluding optional features. In this example, airflow through the pressure equalization unit applies a high pass filter to the audio signals captured by the MEMS microphone.

Example 27 includes the apparatus of any one of examples 20 to 26, including or excluding optional features. In this example, the apparatus includes a barometer subsystem to capture audio signals below a cutoff frequency. Optionally, the barometer subsystem is to measure atmospheric pressures, and a valve of the pressure equalization unit is adjusted based on the measured atmospheric pressures.

Example 28 includes the apparatus of any one of examples 20 to 27, including or excluding optional features. In this example, the pressure equalization unit comprises a plurality of MEMS valves.

Example 29 is a micro electro-Mechanical System (MEMS) microphone. The micro electro-Mechanical System (MEMS) microphone includes a first back plate positioned on top of a first moving plate to create a back cavity, wherein the first moving plate flexes in response to changes in air pressure caused by audio signals; and a means to enable a second airflow to prevent audio signal distortion by reducing a pressure difference in the back cavity at low frequencies.

Example 30 includes the micro electro-Mechanical System (MEMS) microphone of example 29, including or excluding optional features. In this example, the means to enable the second airflow is a valve comprising a valve moving plate, wherein a first end of the valve moving plate is fixedly attached to a MEMS die and the valve moving plate flexes in response to high sound pressure levels such that a second end of the valve moving plate enables airflow to prevent audio signal distortion.

Example 31 includes the micro electro-Mechanical System (MEMS) microphone of any one of examples 29 to 30, including or excluding optional features. In this example, the valve comprises a second backplate.

Example 32 includes the micro electro-Mechanical System (MEMS) microphone of any one of examples 29 to 31, including or excluding optional features. In this example, an electrostatic force applied to the valve moving causes the valve moving plate to flex.

Example 33 includes the micro electro-Mechanical System (MEMS) microphone of any one of examples 29 to 32, including or excluding optional features. In this example, the valve comprises a piezoelectric actuator integrated into the valve moving plate.

Example 34 includes the micro electro-Mechanical System (MEMS) microphone of any one of examples 29 to 33, including or excluding optional features. In this example, the micro electro-Mechanical System (MEMS) microphone includes a hardware control to monitor the audio signal and open the valve in response to signal clipping or signal amplitudes above a threshold.

Example 35 includes the micro electro-Mechanical System (MEMS) microphone of any one of examples 29 to 34, including or excluding optional features. In this example, a cross sectional area of the valve is adjusted to enable a microphone directional response. Optionally, the valve creates a secondary acoustic inlet to enable the directional response.

Example 36 includes the micro electro-Mechanical System (MEMS) microphone of any one of examples 29 to 35, including or excluding optional features. In this example, airflow through the valve effectively applies a high pass filter to the audio signal captured by the first back plate and the first moving plate.

Example 37 includes the micro electro-Mechanical System (MEMS) microphone of any one of examples 29 to 36, including or excluding optional features. In this example, air passes though the valve below a cutoff frequency.

Example 38 includes the micro electro-Mechanical System (MEMS) microphone of any one of examples 29 to 37, including or excluding optional features. In this example, the micro electro-Mechanical System (MEMS) microphone includes a plurality of valves.

Example 39 is a method for a MEMS microphone sound pressure level monitor. The method includes in response to an audio signal level above a threshold, open a MEMS valve, wherein the valve comprises a valve moving plate, wherein a first end of the valve moving plate is fixedly attached to a MEMS die and the valve moving plate flexes in response to high sound pressure levels such that a second end of the valve moving plate enables airflow to prevent audio signal distortion; and in response to an audio signal level below a threshold, close the valve.

Example 40 includes the method of example 39, including or excluding optional features. In this example, the threshold is a decibel level that causes a high sound pressure level at the MEMS microphone.

Example 41 includes the method of any one of examples 39 to 40, including or excluding optional features. In this example, the threshold is a frequency level that causes a high sound pressure level at the MEMS microphone.

Example 42 includes the method of any one of examples 39 to 41, including or excluding optional features. In this example, the valve is opened via an electrostatic force applied to the valve back plate causing the valve moving plate to flex.

Example 43 includes the method of any one of examples 39 to 42, including or excluding optional features. In this example, the valve is opened via a piezoelectric actuator integrated into the valve moving plate.

Example 44 includes the method of any one of examples 39 to 43, including or excluding optional features. In this example, the method includes a software control to monitor the audio signal and open the valve in response to signal clipping or signal amplitudes above a particular threshold.

Example 45 includes the method of any one of examples 39 to 44, including or excluding optional features. In this example, a cross sectional area of the valve is adjusted to enable a microphone directional response.

Example 46 includes the method of any one of examples 39 to 45, including or excluding optional features. In this example, the valve creates a secondary acoustic inlet to enable the directional response.

Example 47 includes the method of any one of examples 39 to 46, including or excluding optional features. In this example, airflow through the valve effectively applies a high pass filter to the audio signal captured by the first back plate and the first moving plate.

Example 48 includes the method of any one of examples 39 to 47, including or excluding optional features. In this example, air passes though the valve below a cutoff frequency.

It is to be noted that, although some embodiments have been described in reference to particular implementations, other implementations are possible according to some embodiments. Additionally, the arrangement and/or order of circuit elements or other features illustrated in the drawings and/or described herein need not be arranged in the particular way illustrated and described. Many other arrangements are possible according to some embodiments.

In each system shown in a figure, the elements in some cases may each have a same reference number or a different reference number to suggest that the elements represented could be different and/or similar. However, an element may be flexible enough to have different implementations and work with some or all of the systems shown or described herein. The various elements shown in the figures may be the same or different. Which one is referred to as a first element and which is called a second element is arbitrary.

It is to be understood that specifics in the aforementioned examples may be used anywhere in one or more embodiments. For instance, all optional features of the electronic device described above may also be implemented with respect to either of the methods or the computer-readable medium described herein. Furthermore, although flow diagrams and/or state diagrams may have been used herein to describe embodiments, the techniques are not limited to those diagrams or to corresponding descriptions herein. For example, flow need not move through each illustrated box or state or in exactly the same order as illustrated and described herein.

The present techniques are not restricted to the particular details listed herein. Indeed, those skilled in the art having the benefit of this disclosure will appreciate that many other variations from the foregoing description and drawings may be made within the scope of the present techniques. Accordingly, it is the following claims including any amendments thereto that define the scope of the present techniques.

What is claimed is:

1. A micro electro-Mechanical System (MEMS) microphone, comprising:

a first back plate positioned on top of a first moving plate, wherein the first moving plate flexes in response to changes in air pressure caused by audio signals; and a valve comprising a valve moving plate that is to bend to open the valve, wherein a first end of the valve moving plate is fixedly attached to a MEMS die and the valve moving plate flexes in response to high sound pressure levels such that a second end of the valve moving plate enables airflow to prevent audio signal distortion, and wherein a hardware control is to monitor the audio signal and open the valve in response to signal clipping or signal amplitudes above a threshold.

2. The MEMS microphone of claim 1, wherein the valve comprises a second backplate.

3. The MEMS microphone of claim 1, wherein an electrostatic force applied to the valve moving causes the valve moving plate to flex.

4. The MEMS microphone of claim 1, wherein the valve comprises a piezoelectric actuator integrated into the valve moving plate.

5. The MEMS microphone of claim 1, wherein a cross sectional area of the valve is adjusted to enable a microphone directional response.

6. The MEMS microphone of claim 5, wherein the valve creates a secondary acoustic inlet to enable the directional response.

7. The MEMS microphone of claim 1, wherein airflow through the valve effectively applies a high pass filter to the audio signal captured by the first back plate and the first moving plate.

8. The MEMS microphone of claim 1, wherein air passes though the valve below a cutoff frequency.

9. The MEMS microphone of claim 1, comprising a plurality of valves.

10. A system for a micro electro-Mechanical System (MEMS) microphone, comprising:

a MEMS microphone comprising a valve with a valve back plate and a valve moving plate that is to bend to open the valve, wherein a first end of the valve moving plate is fixedly attached to a MEMS die and the valve moving plate flexes in response to high sound pressure levels such that a second end of the valve moving plate enables airflow to prevent audio signal distortion;

a memory that is to store instructions and that is communicatively coupled to the microphone; and a processor communicatively coupled to the microphone and the memory, wherein when the processor is to execute the instructions, the processor is to:

determine an audio signal level;

in response to an audio signal level above a threshold, open the valve, wherein a hardware control is to monitor the audio signal and open the valve in response to signal clipping or signal amplitudes above the threshold; and in response to an audio signal level below a threshold, close the valve.

11. The system of claim 10, wherein the threshold is a decibel level that causes a high sound pressure level at the MEMS microphone.

12. The system of claim 10, wherein the threshold is a frequency level that causes a high sound pressure level at the MEMS microphone.

13. The system of claim 10, wherein the valve is opened via an electrostatic force applied to the valve back plate causing the valve moving plate to flex.

14. The system of claim 10, wherein the valve is opened via a piezoelectric actuator integrated into the valve moving plate.

15. The system of claim 10, comprising a software control to monitor the audio signal and open the valve in response to signal clipping or signal amplitudes above a particular threshold.

16. An apparatus to mitigate MEMS microphone signal distortion, comprising:

a MEMS microphone comprising a first back plate positioned on top of a first moving plate to create a back cavity, wherein the first moving plate flexes in response to changes in air pressure caused by audio signals; and a pressure equalization unit to enable a second airflow to prevent audio signal distortion by reducing a pressure difference in the back cavity at low frequencies, wherein the pressure equalization unit is a valve comprising a valve moving plate that is to bend to open the valve, wherein a hardware control is to monitor the audio signal and open the valve in response to signal clipping or signal amplitudes above a threshold.

17. The apparatus of claim 16, wherein a first end of the valve moving plate is fixedly attached to a MEMS die and the valve moving plate flexes in response to high sound pressure levels such that a second end of the valve moving plate enables airflow to prevent audio signal distortion.

18. The apparatus of claim 16, wherein an electrostatic force applied to the pressure equalization unit causes the valve moving plate to flex.

19. The apparatus of claim 16, wherein the pressure equalization unit comprises a piezoelectric actuator integrated into the valve moving plate.

20. The apparatus of claim 16, wherein the pressure equalization unit comprises a hardware control to monitor the audio signals and open the valve in response to signal clipping or signal amplitudes above a threshold.

21. A method for a MEMS microphone sound pressure level monitor, comprising:

in response to an audio signal level above a threshold, opening a MEMS valve via a hardware control that is to monitor the audio signal level and open the MEMS valve in response to signal clipping or signal amplitudes above a threshold, wherein the MEMS valve comprises a valve moving plate that is to bend to open the valve, wherein a first end of the valve moving plate is fixedly attached to a MEMS die and the valve moving plate flexes in response to high sound pressure levels such that a second end of the valve moving plate enables airflow to prevent audio signal distortion; and in response to an audio signal level below a threshold, closing the MEMS valve.

22. The method of claim 21, wherein the threshold is a decibel level that causes a high sound pressure level at the MEMS microphone.

23. The method of claim 21, wherein the threshold is a frequency level that causes a high sound pressure level at the MEMS microphone.

24. The method of claim 21, wherein the valve is opened via an electrostatic force applied to the valve back plate causing the valve moving plate to flex.

* * * * *